US008640932B2

(12) United States Patent
Dalton et al.

(10) Patent No.: US 8,640,932 B2
(45) Date of Patent: Feb. 4, 2014

(54) SHOOTER'S CUP

(76) Inventors: Matt Dalton, Tulare, CA (US); Stephen Springer, Tulare, CA (US)

( * ) Notice: Subject to any disclaimer, the term of this patent is extended or adjusted under 35 U.S.C. 154(b) by 0 days.

(21) Appl. No.: 13/367,310

(22) Filed: Feb. 6, 2012

(65) Prior Publication Data

US 2012/0279108 A1 Nov. 8, 2012

Related U.S. Application Data

(60) Provisional application No. 61/473,065, filed on Apr. 7, 2011.

(51) Int. Cl.
*F41C 27/22* (2006.01)

(52) U.S. Cl.
USPC ..... 224/149; 42/94

(58) Field of Classification Search
USPC ..... 42/94, 71.01, 73; 224/149
See application file for complete search history.

(56) References Cited

U.S. PATENT DOCUMENTS

| | | | | |
|---|---|---|---|---|
| 3,708,801 | A * | 1/1973 | Davis | 2/94 |
| 4,243,165 | A * | 1/1981 | Schuler | 224/149 |
| 4,690,316 | A * | 9/1987 | Peterson | 224/674 |
| 8,056,778 | B1 * | 11/2011 | Michaux | 224/149 |
| 8,215,045 | B2 * | 7/2012 | Mitchell | 42/71.01 |
| 2002/0036219 | A1 * | 3/2002 | Neighbors | 224/149 |
| 2011/0131860 | A1 * | 6/2011 | Borkowski | 42/94 |

* cited by examiner

*Primary Examiner* — Michelle Cement
*Assistant Examiner* — John D Cooper
(74) *Attorney, Agent, or Firm* — DLA Piper LLP (US)

(57) ABSTRACT

The present system provides a detachable cup or receptacle for receiving the butt stock of a weapon so that a greater portion of the surface area of the butt stock is stabilized when aiming and firing a weapon. The system provides fastening means for removably fastening the cup to the uniform of a shooter when wearing body armor. For ease of use, the system includes a graduated positioning system that can receive the butt stock and allow it to slide into place where, in one embodiment, it slips into a recessed area that matches the dimension of the butt stock for greater security of the positioning of the weapon. The weapon can be easily removed from the cup so that the shooter's mobility and the ability of the shooter to move the weapon back and forth from a shooting position is not compromised.

7 Claims, 4 Drawing Sheets

SHOOTER'S CUP

This patent application claims priority to U.S. Provisional patent application 61/473,065 filed on Apr. 7, 2011 which is incorporated by reference herein in its entirety.

BACKGROUND

Weapons such as rifles and the like that employ a stock are meant to be used by pressing the stock into the shoulder area of the shooter. Such use and placement allows the shooter to have greater control over the motion (or stillness) of the weapon when aiming so that the weapon may be fired more accurately. Typically, proper placement of a weapon is such that over 90% of the surface area of the butt stock of the weapon is in contact with the shoulder of the shooter.

A problem arises when shooters are using body armor such as Kevlar vests and the like. The body armor changes the silhouette of the shooter's shoulder in such a way as to prevent effective positioning of the butt stock of the weapon. In many cases, the shooter is using less than 50% of the surface area of the butt stock when aiming and firing the weapon. This leads to aiming problems and can be the difference between life and death for the shooter in a combat situation.

SUMMARY

The present system provides a detachable cup or receptacle for receiving the butt stock of a weapon so that a greater portion of the surface area of the butt stock is stabilized when aiming and firing a weapon. The system provides fastening means for removably fastening the cup to the uniform of a shooter when wearing body armor. For ease of use, the system includes a graduated positioning system that can receive the butt stock and allow it to slide into place where, in one embodiment, it slips into a recessed area that matches the dimension of the butt stock for greater security of the positioning of the weapon. The weapon can be easily removed from the cup so that the shooter's mobility and the ability of the shooter to move the weapon back and forth from a shooting position is not compromised.

DETAILED DESCRIPTION OF THE SYSTEM

The shooter's cup in one embodiment allows the rapid engagement and disengagement of the butt stock of a weapon with the cup in an eyes-free manner. The graduated shape of the cup allows the shooter to place the butt stock, in the cup with a significant amount of "play" and then slide it down to the secure position, all without the need to look it into place.

Figure 1:
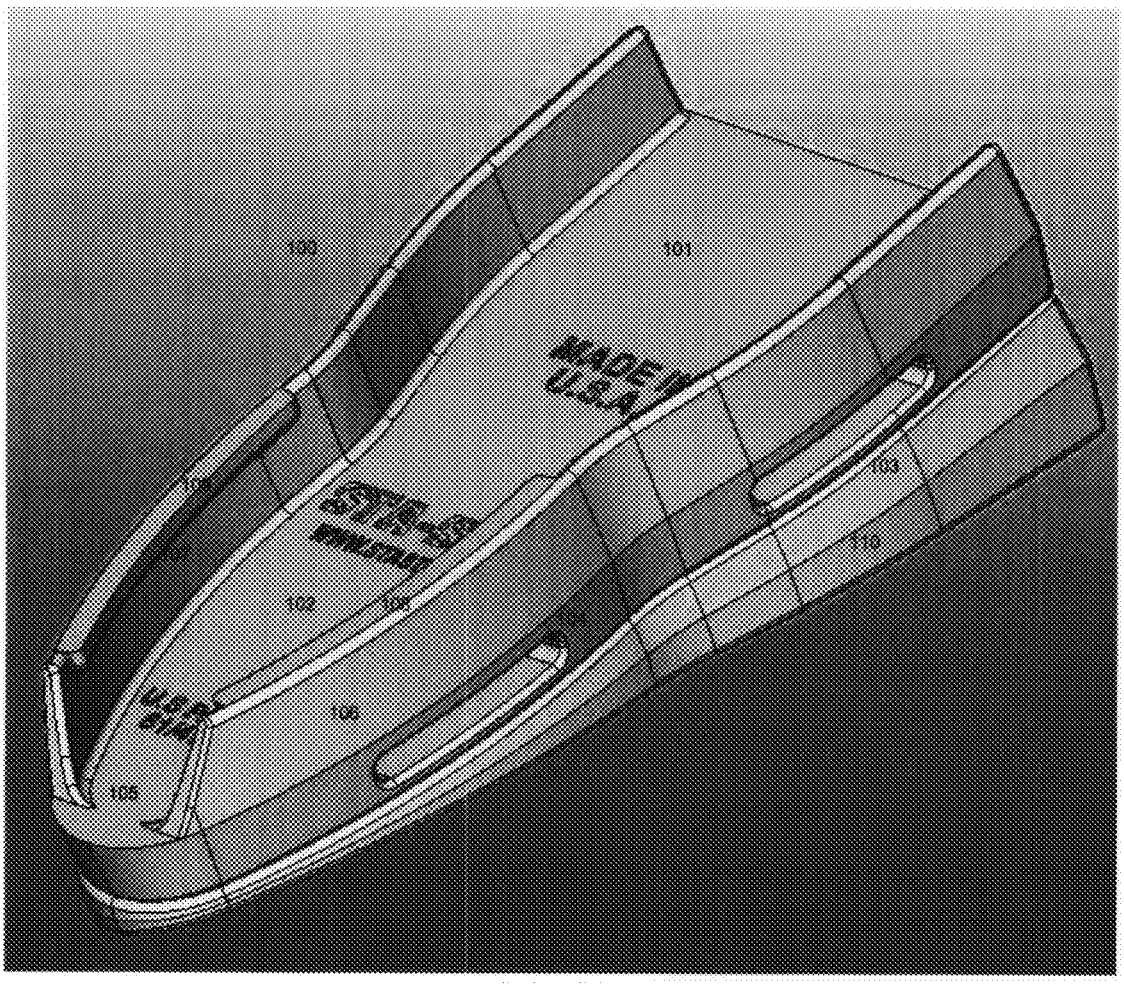
FIG. 1 is perspective view of an embodiment of the shooter's cup.

FIG. 1 is a perspective view of an embodiment of the cup. The cup 100 has a somewhat V shaped configuration that is wider at the top than at the bottom. The wider region 101 is used to easily receive the butt stock of a weapon without the need for the shooter to look at the cup as the weapon is placed. With a minimum of practice, the shooter is able to repeatedly engage and disengage the weapon from the cup.

The cup includes a more narrow region 102 that is of the approximate dimensions of the butt stock of the weapon used by the shooter. In one embodiment, each cup is designed to be associated with a particular size and shaped butt stock so that, when inserted into the region 102, the weapon is in a steady and secure position for aiming and accurately firing.

In one embodiment, the cup is such that it may receive a plurality of sizes of butt stocks from a variety of weapons. The narrowing region 102 is such that butt stocks of different sizes will be able to fit at different points between the sides of the cup. The cup 100 includes an opening 105 so that, if sufficiently narrow, a portion of the butt stock might extend through opening 105 while the remainder of the butt stock is captured in a compression fit by sidewalls 106 and 107 of the cup 100. The cutout area 105 at the toe of the cup is angled at approximately 45 degrees to enable the cup to receive different types of butt stocks that may include sling arrangements. The slings can descend below the open toe region 105 to prevent snarling and aiming interference when using the cup.

In one embodiment, the cup 100 has overhanging edges 108 and 109 in the narrow region 102 of the cup to further aid in the gripping of butt stocks of weapons to be used with the cup. This lip region prevents the inadvertent removal of the butt stock during use. The butt stock must be purposefully slid up and out of the cup for removal.

The cup 100 may include openings 103 and 104 on each side of the cup to allow a strap or other fastening means to be passed there-through. The slots can go through the cup 100 below the surface that receives the butt stock so that the straps do not interfere with the positioning or aiming of a weapon inserted into the cup.

The cup slots 103 and 104 receive straps to attach the cup to the clothing of a shooter who may be wearing body armor or an armored vest. The fastening means in one embodiment comprise two straps with snaps affixed thereto. The straps can be used to fasten the cup to the shoulder region of a shooter's clothing, such as through loops on the clothing. In other embodiments, the straps can have snaps that snap directly onto snaps affixed to the clothing. The fastening means may comprise any suitable means for retaining the cup including, but not limited to, Velcro™ and the like. This can reduce the time it takes for the user to get the cup in place and ready to use in a firing situation.

The cup 100 includes a base portion 110 that may be angled to be relatively thicker at the back than at the front. Due to the nature of the mounting of the cup on a shooter wearing body armor, the angled base 110 allows the cup 100 to be angled properly for aiming while maintaining full contact of the butt stock against the cup.

In addition to providing a secure and stable location for the butt stock of the weapon, the cup also provides dispersion of recoil energy over a larger surface area than with just the stock alone. That allows the user to use the weapon without fear of recoil fatigue and with reduced movement caused by recoil energy.

Figure 2:
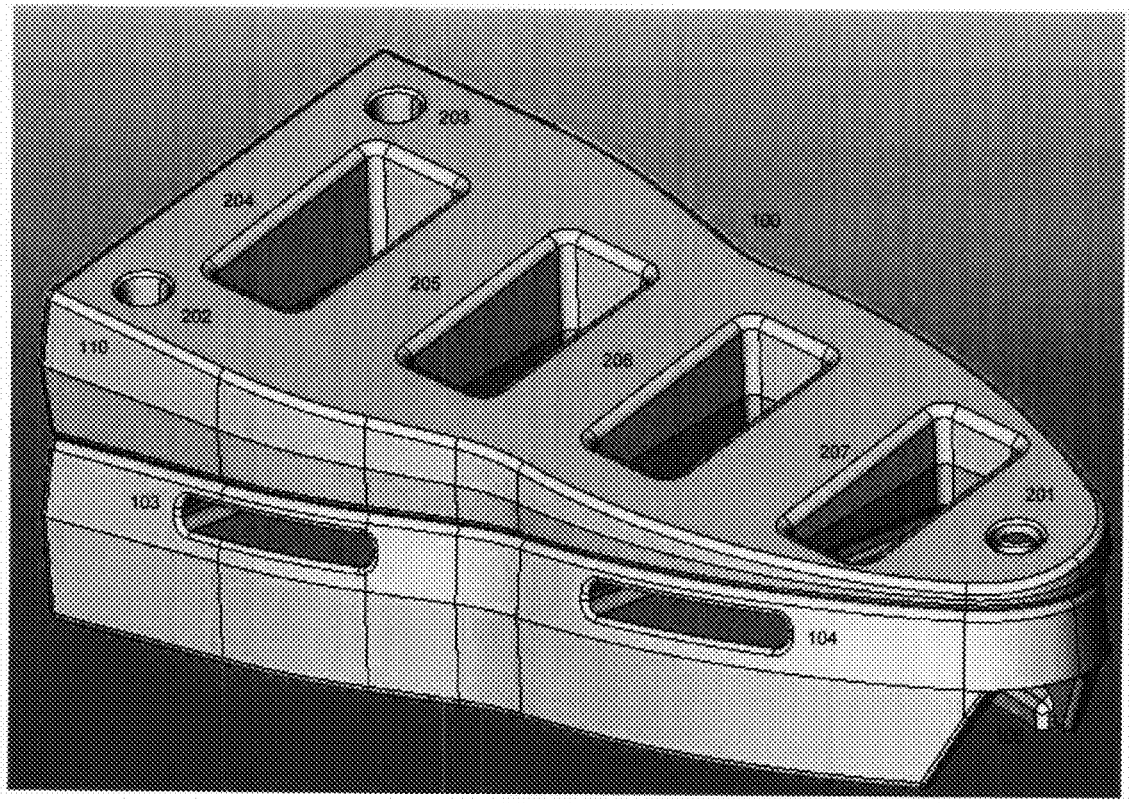
FIG. 2 illustrates a bottom perspective view of the embodiment of FIG. 1.

FIG. 2 illustrates a bottom perspective view of the embodiment of FIG. 1. As can be seen, the strap slots 103 and 104 are beneath the surface of the area of the cup that receives the butt stock. The base portion 110 of the cup (also referred to as a wedge) is angled as noted above to aid in the positioning of the cup in a forward facing firing position even on a sloped shoulder, armor, or vest of a user.

The base 110 can be attached separately to the cup by fasteners 201, 202, and 203, which may be screws, rivets, nuts, and the like. The base 110 includes cut-outs 204, 205, 206, and 207. These cut-outs allow mounting straps to be weaved there-through for a different manner of mounting the cup to the users uniform or clothing. In one embodiment, the base 110 may be removably coupled to the upper region by the fastening means 201-203. This may be via male and female compression fit fasteners so the base 110 is mounted on the shooter and the cup may be coupled and decoupled as desired. This also allows the shooter to attach different size and configuration of cups to accommodate different size and shape of butt stocks, depending on the weapon of choice.

In operation, the shooter directs the butt stock into the top portion 101 of the cup and then moves the stock down into the cup. The V shaped sides of the cup guide and register the butt stock into place. When the shooter feels the downward movement of the butt stock cease, the shooter can then direct the movement of the butt stock inward towards the shooter's body, so that the butt stock seats itself in the cup, ready for stable aiming and firing.

Figure 3:
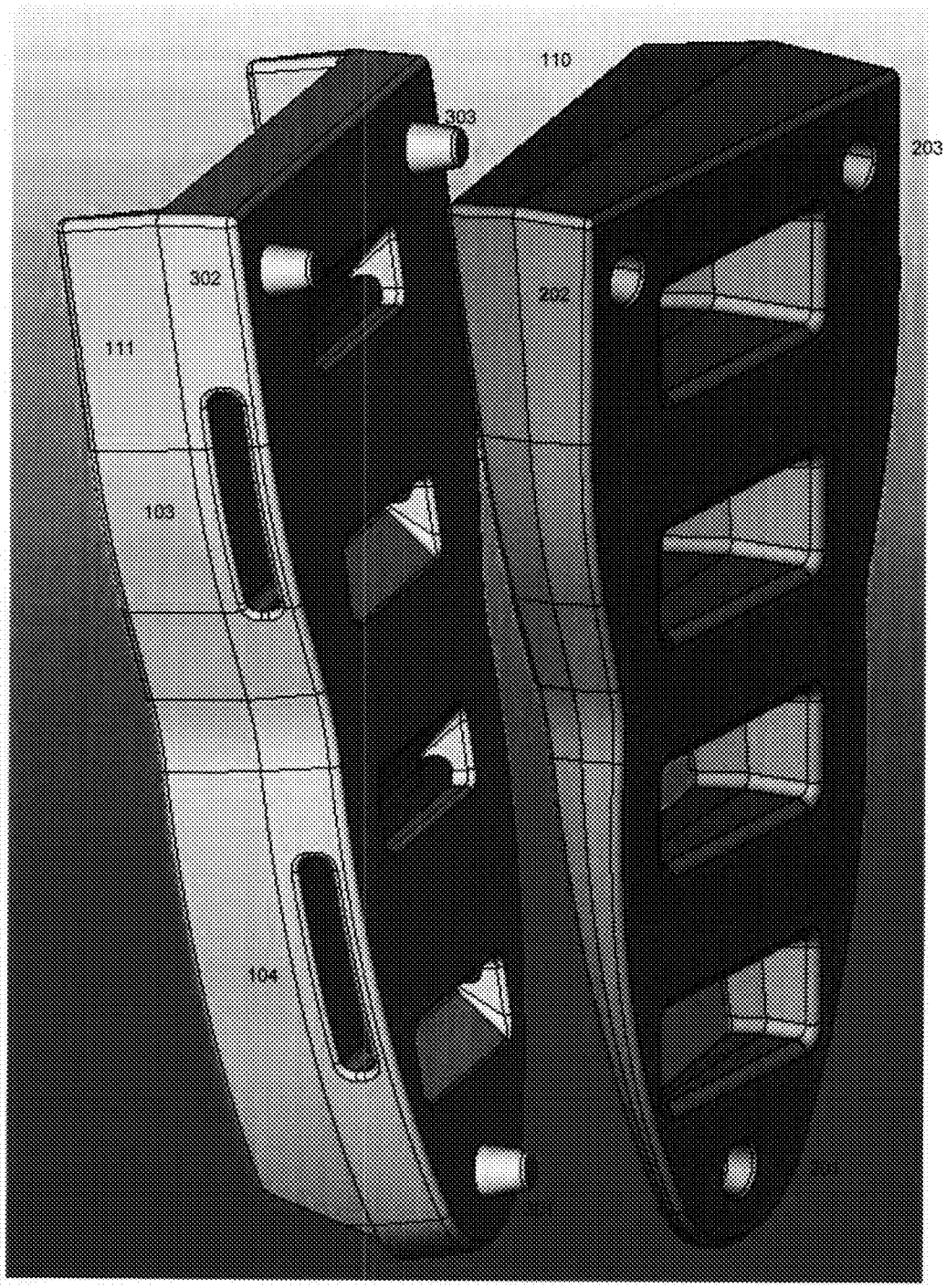
FIG. 3 illustrates an embodiment of a two section cup.

FIG. 3 illustrates an embodiment of the cup illustrating two part construction. The cup 100 includes two removably coupled sections, the base section 110 and the upper section 111. The upper section 111 in this embodiment includes the slots 103 and 104 for horizontal straps as well as openings in the bottom surface to receive a strap for vertical mounting as a separate component if desired.

The top section 111 includes male members 301, 302 and 303 that register with and engage corresponding female openings 201, 202, and 203 in the bottom section 110 for removably coupling the sections together. In one embodiment, the user may weave a strap through the bottom face openings in both sections as an additional way to retain the sections together during use.

As shown in FIG. 3, the base section 110 may be angled from front to hack as well as from side to side. Referring to FIG. 3, the width of the base 110 increases from the foreground to the background, as well as from the toe to the heel. In this manner, the upper section may be flat while the lower section is fully contacting a slanted area of the shooter, such as the shoulder of body armor.

Figure 4:
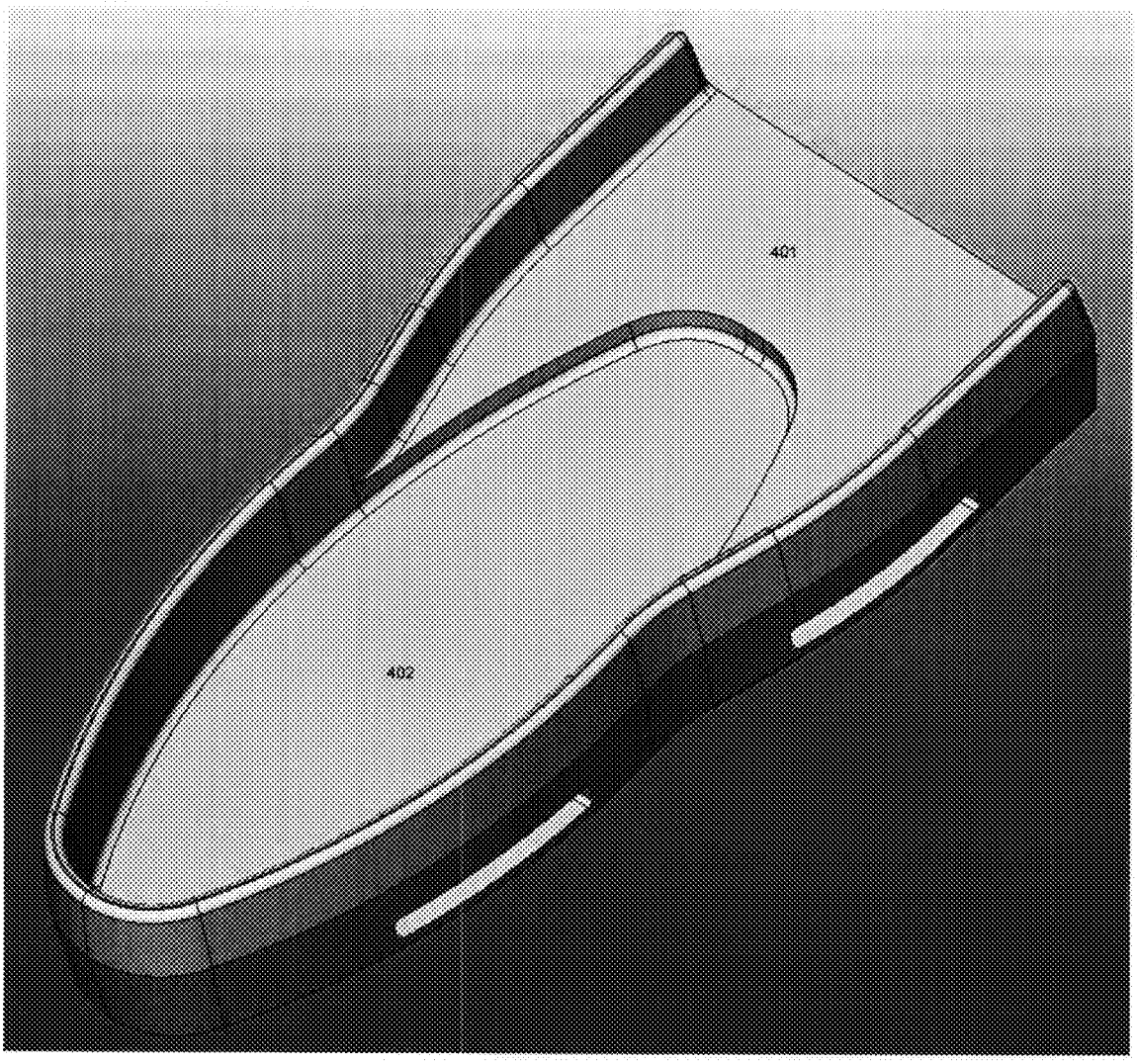
FIG. 4 is a perspective view of an alternate embodiment of the cup.

FIG. 4 illustrates an alternate embodiment of the cup. The cup in this embodiment also has a somewhat V shaped configuration that is wider at the top than at the bottom. The wider region 401 is used to easily receive the butt stock of a weapon without the need for the shooter to look at the cup as the weapon is placed.

The cup includes a recessed region 402 that is of the approximate dimensions of the butt stock of the weapon used by the shooter. In one embodiment, each cup is designed to be associated with a particular size and shaped butt stock so that, when inserted into the recessed area 402, the weapon is in a steady and secure position for aiming and accurately firing.

In operation, the shooter directs the butt stock into the top portion 401 of the cup and then moves the stock down into the cup. The V shaped sides of the cup guide and register the butt stock into place at recessed region 402. When the shooter feels the downward movement of the butt stock cease, the shooter can then direct the movement of the butt stock inward towards the shooter's body, so that the butt stock seats itself in the recessed region 402, ready for stable aiming and firing.

This embodiment also includes slots for receiving straps or other fastening means for retaining the cup on the uniform, armor, or clothing of the user.

The cup may be comprised of any suitable material, such as molded plastic, or any other suitable material.

What is claimed is:

1. A device comprising:

a cup comprising first and second removably coupled sections, wherein the first removably coupled section comprises first and second butt stock retaining walls orthogonal to an upper surface, the first and second walls being closer together at a first end and further apart at a second end, wherein all of the bottoms of the first and second walls are located on the upper surface, the first and second walls are configured to provide a compression fit to at least a portion of a butt stock, and the first removably coupled section is removably coupled to the second removably coupled section.

2. The device of claim 1 further including at least one slot formed below the upper surface for receiving fasteners for securing the device to a user.

3. The device of claim 1 further including a first opening at the first end and a second opening at the second end.

4. The device of claim 1 further including a first lip on the first wall and a second lip on the second wall for retaining the butt stock in place during operation.

5. The device of claim 1 further including a plurality of slots or a lower surface of the device for receiving fasteners for securing the device to a user.

6. The device of claim 1 wherein the second removably coupled section is wedge-shaped in the longitudinal direction.

7. The device of claim 1 wherein the second removably coupled section is wedge-shaped in the latitudinal direction.

* * * * *